US008539698B1

(12) United States Patent
Woodruff

(10) Patent No.: US 8,539,698 B1
(45) Date of Patent: Sep. 24, 2013

(54) FOOTWEAR SAFETY APPARATUS, DEVICE, AND METHOD

(76) Inventor: Michael J. Woodruff, Owasso, OK (US)

( * ) Notice: Subject to any disclaimer, the term of this patent is extended or adjusted under 35 U.S.C. 154(b) by 642 days.

(21) Appl. No.: 12/758,843

(22) Filed: Apr. 13, 2010

Related U.S. Application Data

(60) Provisional application No. 61/212,463, filed on Apr. 13, 2009.

(51) Int. Cl.
*A43B 3/30* (2006.01)

(52) U.S. Cl.
USPC ..... 36/59 R; 36/103; 36/25 R; 36/105

(58) Field of Classification Search
USPC ..... 36/25 R, 59 C, 59 R, 103, 105
See application file for complete search history.

(56) References Cited

U.S. PATENT DOCUMENTS

| | | | | | |
|---|---|---|---|---|---|
| 2,793,136 | A * | 5/1957 | Root | 428/147 |
| 3,099,885 | A * | 8/1963 | Jordan et al. | 36/59 R |
| 3,879,864 | A | 4/1975 | Exley | |
| 3,888,026 | A * | 6/1975 | Dassler | 36/25 R |
| 4,007,549 | A * | 2/1977 | Moore | 36/59 C |
| 4,012,855 | A * | 3/1977 | Gardner | 36/29 |
| 4,069,515 | A * | 1/1978 | Swallow et al. | 2/239 |
| 4,308,673 | A * | 1/1982 | Mobius | 36/68 |
| 4,361,971 | A * | 12/1982 | Bowerman | 36/129 |
| 4,388,768 | A * | 6/1983 | Mobius | 36/68 |
| 4,434,565 | A * | 3/1984 | Haley | 36/7.3 |
| 4,445,286 | A * | 5/1984 | Norton | 36/32 R |
| 5,038,500 | A * | 8/1991 | Nicholson | 36/59 C |
| 5,315,768 | A * | 5/1994 | Pacheco | 36/7.1 R |
| 5,699,628 | A * | 12/1997 | Boatwalla | 36/59 C |
| 6,055,748 | A | 5/2000 | Harrison | |
| 6,255,235 | B1 * | 7/2001 | Hiraoka et al. | 442/101 |
| 6,385,866 | B1 * | 5/2002 | Sotter | 36/67 R |
| 6,817,115 | B2 * | 11/2004 | Polifroni | 36/91 |
| 7,353,626 | B2 * | 4/2008 | Otis et al. | 36/59 R |
| 7,594,345 | B2 * | 9/2009 | Fusco | 36/59 R |

(Continued)

OTHER PUBLICATIONS

Andrew Kim Law Firm, PLLC, Slip and Fall Statistics, retrieved on 03/23/2010I; retrieved from www.wainjurylaw.com/library/slip-and-fall-statistics-washington-state.cfm.

(Continued)

*Primary Examiner* — Khoa Huynh
*Assistant Examiner* — Katharine Gracz
(74) *Attorney, Agent, or Firm* — Brian S. Steinberger; Law Offices of Brian S. Steinberger, P.A.

(57) ABSTRACT

A footwear traction device is disclosed that enhances regular or slip-resistant shoes during a slip-in-progress. The traction device includes an adhesive layer embedded with microscopic friction additives, natural or engineered, and partially covered with an epoxy resin in a design that pierces and grips the microscopic roughness of a surface and any contaminants thereon, providing emergency traction during a slip. The footwear traction device provides more than one opportunity to recover from a slip and regain traction. In the event that a fall is unavoidable, the footwear traction device provides a first and a second push back force, spreading the force of the fall over a larger area, minimizing the absolute force of the fall and providing a safer trajectory during the fall. The slip recovery method and system of the present invention offers an economical solution that reduces the financial and human toll caused by slip-and-fall accidents and deaths.

14 Claims, 9 Drawing Sheets

(56) References Cited

U.S. PATENT DOCUMENTS

| | | | | |
|---|---|---|---|---|
| 7,596,889 | B2 | 10/2009 | Pasternak | |
| 2002/0078598 | A1* | 6/2002 | Bell | 36/59 R |
| 2002/0148138 | A1* | 10/2002 | Egan | 36/7.1 R |
| 2004/0163190 | A1* | 8/2004 | Loughran | 12/146 B |
| 2004/0163282 | A1* | 8/2004 | Pan | 36/59 R |
| 2005/0229428 | A1* | 10/2005 | Holcomb | 36/7.1 R |
| 2007/0130801 | A1* | 6/2007 | Wu | 36/59 R |
| 2007/0271819 | A1* | 11/2007 | Chen | 36/43 |
| 2008/0282577 | A1* | 11/2008 | Holeyfield | 36/7.1 R |
| 2009/0083996 | A1* | 4/2009 | Clancy et al. | 36/88 |

OTHER PUBLICATIONS

Kim, et al., Research on Slip Resistance Measurements—A New Challenge, Industrial Health, 2008, pp. 66-76, vol. 46.

* cited by examiner

FOOTWEAR SAFETY APPARATUS, DEVICE, AND METHOD

This invention claims the benefit of priority of U.S. Provisional Patent Application Ser. No. 61/212,463 filed Apr. 13, 2009.

FIELD OF THE INVENTION

The present invention relates to footwear safety, and particularly, to a sharp piercing composition, economical method of manufacture, device, system and method of preventing slips and falls for a user of the footwear safety apparatus or device provided to herein.

BACKGROUND AND PRIOR ART

Slips and falls are one of the most common causes of injuries and fatalities in the general community and the workplace. Slips are primarily caused by a slippery surface and compounded by spilled contaminants or ironically from a build-up of contaminants caused by regular floor cleanings.

The force that allows a person to walk without slipping is commonly referred to as "traction." Common experience shows that dry concrete sidewalks have good traction, while icy surfaces or freshly waxed floors can have low traction; even regular floor cleanings without waxing cause a slippery contamination. Technically, traction is measured as the "coefficient of friction" (COF). A higher coefficient of friction means more friction, and therefore more traction. The coefficient of friction depends on two things: the quality of both the walking surface and the soles of the shoes worn by the walker.

To prevent slips and falls, a high coefficient of friction (COF) between the shoe and walking surface is needed. On icy, wet, and oily surfaces, the coefficient of friction (COF) can be as low as 0.10 with shoes that are not slip resistant. A COF of 0.40 to 0.50 or more is needed for excellent traction. To put these figures in perspective, a brushed concrete surface and a rubber heel will often show a COF greater than 1.0. Leather soles on a wet smooth surface, such as ceramic tile or ice, may have a COF as low as 0.10.

Footwear traction devices or safety shoes are known in the art and are designed to provide a high coefficient of friction (COF) in footwear that is slip-resistant. Currently, shoes with soft rubber soles and heels with rubber cleats are manufactured and sold as the primary means of reducing slip and fall accidents. However, rubber outsoles currently attempt to grip, not pierce, the microscopic roughness of the floor surface, as illustrated in FIG. 1.

FIG. 1 is a prior art representation of the microscopic interaction with a floor surface 11 using slip-resistant outsoles 10. Fall prevention products historically have focused on slip-resistant footwear made of rubber compounds 10 that attempt to grip the microscopic floor roughness 11. Dangerous slips still occur especially when moisture or contaminants 12 reduce friction. Moisture and contaminants 12 can interfere with the sole grip causing the outsole 10 to rapidly slide forward resulting in a dangerous loss of balance.

In a 2010 website: http://www.waininjurylaw.com/library/slip-and-fall-statictics-washington-state.cfm, the Andrew Kim Law Firm, PLLC reports basic slip and fall statistics, taken from the *National Safety Council* and the *Bureau of Labor Statistics* which include the following data Over one million people in the Unites States experience a significant slip, trip, or fall each year. An average of 17,000 Americans die from their slip and fall accidents. Falls account for 25% of serious injuries in the workplace. A death from an on-the-job slip and fall is estimated to cost an average of $940,000 on top of the victim's family's loss and trauma. Slips and falls are the third largest cause of workplace injuries. Slips and falls are the single most common reason for visits to the emergency room. The average cost of a slip and fall injury is $28,000, including medical bills, physical therapy, and missed wages. Slips and falls are the number two cause of accidental death and disability, following automobile accidents that are number one. Slips and falls lead to millions of lost workdays per year in North America. Seventy percent of slips and falls occur on level ground. Fifty five percent of people over age 40 have suffered a debilitating slip and fall accident during their lifetimes. The various costs to society of accidents and deaths due to slips and falls are based on 2010 U.S. dollar values.

Thus, beyond the human toll caused by slip-and-fall accidents, there is a financial toll that should be the concern of every one. The social burdens related to slip-and-fall injuries are tremendous. So, even if a personal injury as the result of a slip-and-fall accident is avoided, the impact of the burden placed on society is in the form of higher insurance rates and higher costs for products and services to all persons.

It is important to the U.S. economy, the robustness of the U.S. population and the heavy burden on the healthcare system, to reduce and eliminate the occurrence of slips and falls by any means necessary.

Healthy people utilize the same series of movements to walk safely and preserve balance; there are ten or more standard movements utilized when attempting to recover from a slip. Slips and falls happen so quickly most of the fall prevention movements go unnoticed, without the aid of specialized technical equipment. Once a traditional rubber heel first strikes the floor or floor contaminant, a series of natural recovery movements begin, less than a quarter of a second is available to recover. The limited amount of time available to recover requires the traction apparatus to complement the instinctive human recovery motions.

The known prior art includes several patents listed below that describe anti-slip attachments or outsoles of shoes.

U.S. Pat. No. 3,879,864 to Exley describes a toothed bar which is pivotably attachable to the sides of the heel of a shoe or overshoe so that it may be rotated, when used, into a position on the exterior surface of the heel to furnish a gripping surface on snow or ice.

U.S. Pat. No. 6,055,748 to Harrison discloses an anti-slip attachment for attachment to the bottom surface of a shoe outsole to prevent a wearer from slipping on a surface. The attachment is a plurality of flexible traction strips having an adhesive surface on a first side and a roughened traction surface on a second side.

U.S. Pat. No. 7,596,889 to Pasternak et al describes footwear outsoles with a plurality of tread members in the shape of stars to provide slip resistant footwear.

The above patents disclose the state of the art in relation to footwear safety devices and attachments, there is still a need for an apparatus or device that provides traction recovery and minimizes or reduces the slips and falls of people.

Improvements are needed so that people can recover from a slip or at least minimize fall forces. Such an improvement would save valuable time and resources by minimizing or decreasing the lost production of workers and significant costs of healthcare and treatment for slip and fall injuries. Such an improvement would not require re-tooling the manufacture of existing safety shoes; also, it should be an inexpensive device that is universally acceptable to all shoe wearers; added as an accessory and result in a significant decrease in slip and fall accidents in the U.S. or wherever this problem exists. The present invention provides the improvements needed and fulfills a void in the safety footwear industry.

SUMMARY OF THE INVENTION

The present invention provides a new footwear traction apparatus or device that produces more than one opportunity to recover from a slip or at least minimize fall forces. As a last resort, the footwear traction apparatus or device positions the body for a fall and minimizes the absolute force felt by any one part of the body, such as, head, hip, elbow and the like, thereby reducing the risks of serious injury.

The design and precision with which the footwear traction device of the present invention is made contributes many advantages over the prior art. The new and novel features include, but are not limited to, an apparatus or device that is embedded with microscopic friction additives designed to pierce and grip the microscopic roughness of a walking surface and any contaminants thereon, providing emergency traction during a slip. The micro-shapes on the footwear attachment pierce and grip the floor surface and any contaminants to create guaranteed and measurable traction. The microscopic protrusions on the device are harder and stronger than all floor surfaces including tile, cement, stone, and steel floors.

The first objective of the present invention is to provide a footwear traction apparatus or device that pierces the microscopic roughness of a walking surface and any contaminants thereon. Traditional slip-resistant footwear fails to stop a slip when a contaminant other than minor moisture is present.

The second objective of the present invention is to provide a footwear traction apparatus or device that is made as a separate component and attached mechanically to a shoe by the footwear manufacturer.

The third objective of the present invention is to provide a footwear traction apparatus or device that does not contact the floor surface until a person begins to slip.

The fourth objective of the present invention is to provide a footwear traction apparatus or device that is a low cost add-on which does not require expensive changes in the way suppliers design or manufacture footwear.

The fifth objective of the present invention is to provide a footwear safety option designed to create traction when a slip cannot be avoided by traditional slip-resistant outsole technology.

The sixth objective of the present invention is to provide a footwear traction apparatus or device with push back traction so that the fall energy is directed in a more useful way to minimize the absolute force felt by the head or hips of a person who has lost his or her balance.

The seventh objective of the present invention is to provide a footwear traction apparatus or device that does not obstruct or interfere with the comfort offered by inexpensive rubber outsole technology.

The eighth objective of the present invention is to provide a footwear traction apparatus or device with a hard slip-recovery heel attachment that only contacts the floor when the soft rubber sole has lost traction.

The ninth objective of the present invention is to provide a footwear traction apparatus or device with a traction material that reacts rapidly by complementing the natural human slip response motions.

The tenth objective of the present invention is to provide a footwear traction apparatus or device that is durable, cost effective and placed manually on the heel of footwear, allowing for cost effective human testing with a variety of heel shapes and micro particle shapes. Human slip laboratory testing is the most accurate form of confirming slip recovery performance; however, specialty software and laboratory equipment exists that provides useful safety data.

The eleventh objective of the present invention is to provide a footwear traction apparatus or device that is an aid to people wearing traditional slip-resistant rubber outsoles, so if that technology fails to prevent a slip, the invention will still offer slip recovery opportunities even during a "slip in progress".

The twelfth objective of the present invention is to provide a footwear traction apparatus or device that affords the necessary traction to position the body of a person who has slipped for a safer fall by minimizing the absolute force.

Further objects and advantages of this invention will be apparent from the following detailed description of a presently preferred embodiment, which is illustrated in the accompanying drawings.

BRIEF DESCRIPTION OF THE FIGURES

Referring particularly to the drawings, the drawings are for the purposes of illustration only, and not limitation.

DESCRIPTION OF THE PREFERRED EMBODIMENT

Figure 1:
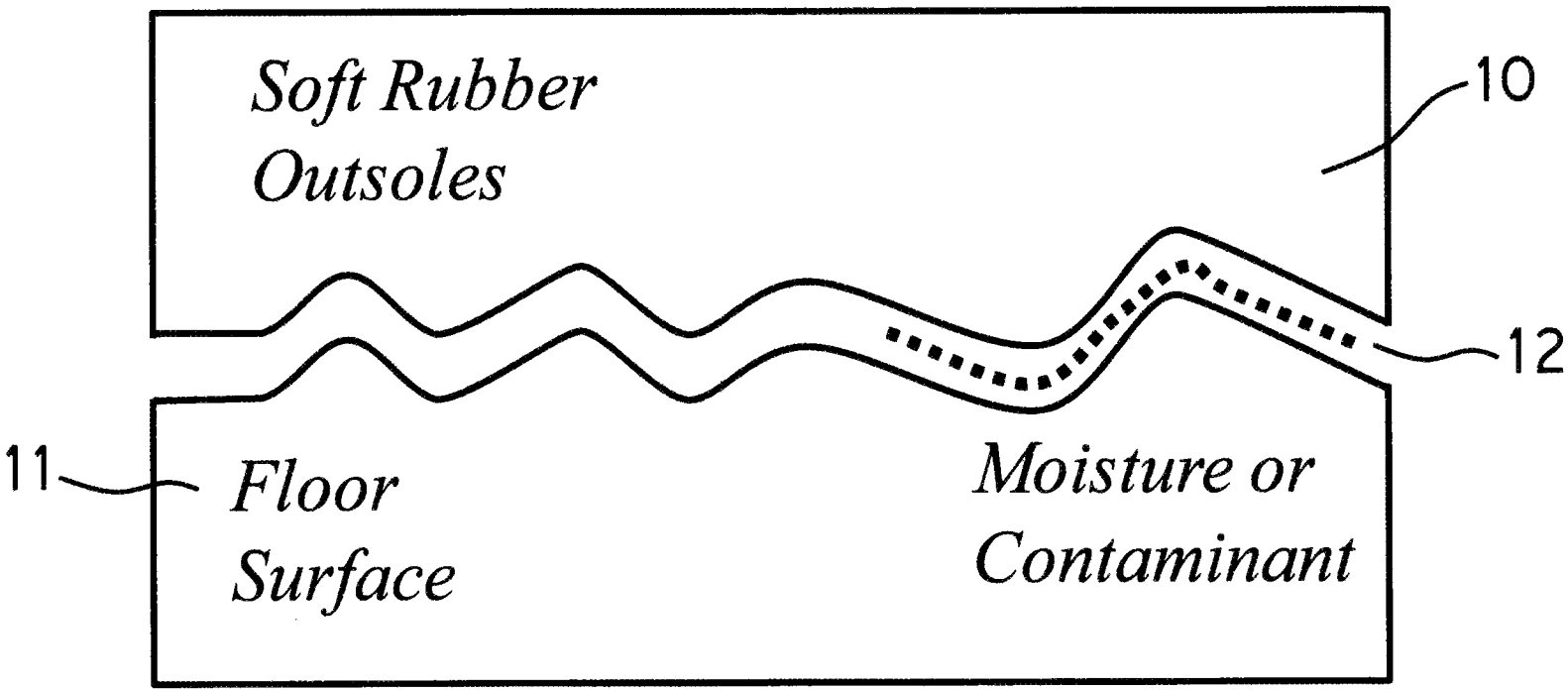
Fig. 1 (Prior Art)
FIG. 1 is a cross-sectional view of a traditional rubber outsole of a safety shoe in contact with a floor surface with moisture or contaminant present. (Prior Art)

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

It would be useful to discuss the meanings of some words used herein and their applications.

"Amplitude" is used herein to refer to the greatness of size or magnitude of the peaks and shape feature of protruding portions of the footwear apparatus or device of the present invention.

"Beveled Heel" is used herein to refer to shoe heel having a beveled area or surface that joins the sole of the shoe at an angle that is not a right angle, preferably between approximately 5 degrees to approximately 35 degrees, most preferably, approximately 10 degrees. Shoes with a beveled heel can included shoes with an upper made of leather, cloth or synthetic material intended to cover the heel of the wearer, open back shoes, sandals and the like.

The phrase "coefficient of friction (COF)" is used herein to refer to a dimensionless scalar value which describes the ratio of the force of friction between two bodies and the force pressing them together. The coefficient of friction depends on the materials used; for example, ice on steel has a low coefficient of friction, while rubber on pavement has a high coefficient of friction. Coefficients of friction range from near zero to greater than one; under good conditions, a tire on concrete may have a coefficient of friction of 1.7. With regard to a person walking, it is the ratio of the force that maintains contact between a person and a floor or walking surface and the frictional force that resists the motion of the person walking.

"Economical" is used to refer to the nominal costs associated with producing, safety testing, customization and integration into the existing global footwear assembly process. The slip recovery method and system of the present invention, economically, reduces the human and financial toll caused by slip-and-fall accidents and deaths. The shape of the traction device is customized and safety tested for each outsole design. Footwear outsoles are typically massed produced and attached to more than one shoe type. The custom shapes with protruding micro fins or teeth, can be held together cost effectively with a strong resin. Shapes can also be formed at higher costs by industrial pressing, laser shaping, or with engineered ceramics. The final shape and friction properties of the device can be formulated by altering the amounts and types of densification aids.

The phrase "engineered ceramics" is used herein to refer to materials known in the art as engineered, technical or advanced ceramics which consist of oxides, such as, aluminum and silica and non-oxides, such as, carbides, nitrides and borides with physical properties or performance beyond the scope of metals or plastics. Suppliers can tailor individual components to handle specific needs by adjusting factors such as porosity, grain size and heat treatment.

"Hardness" is used herein to refer to the measurement of durability and hardness of microscopic particles on the Mohs Hardness Scale.

"Traction" is used herein to refer to the force that allows a person to walk without slipping.

"Wavelength" is used herein as a measure of the distance between repetitions of a shape feature such as peaks, valleys; more specifically, it is the distance between any two consecutive points with the same or similar shape, such as peaks, crests, troughs, or zero crossings in the irregular periodic waveform of the footwear apparatus or device of the present invention.

Footwear Apparatus or Device

Figure 2:
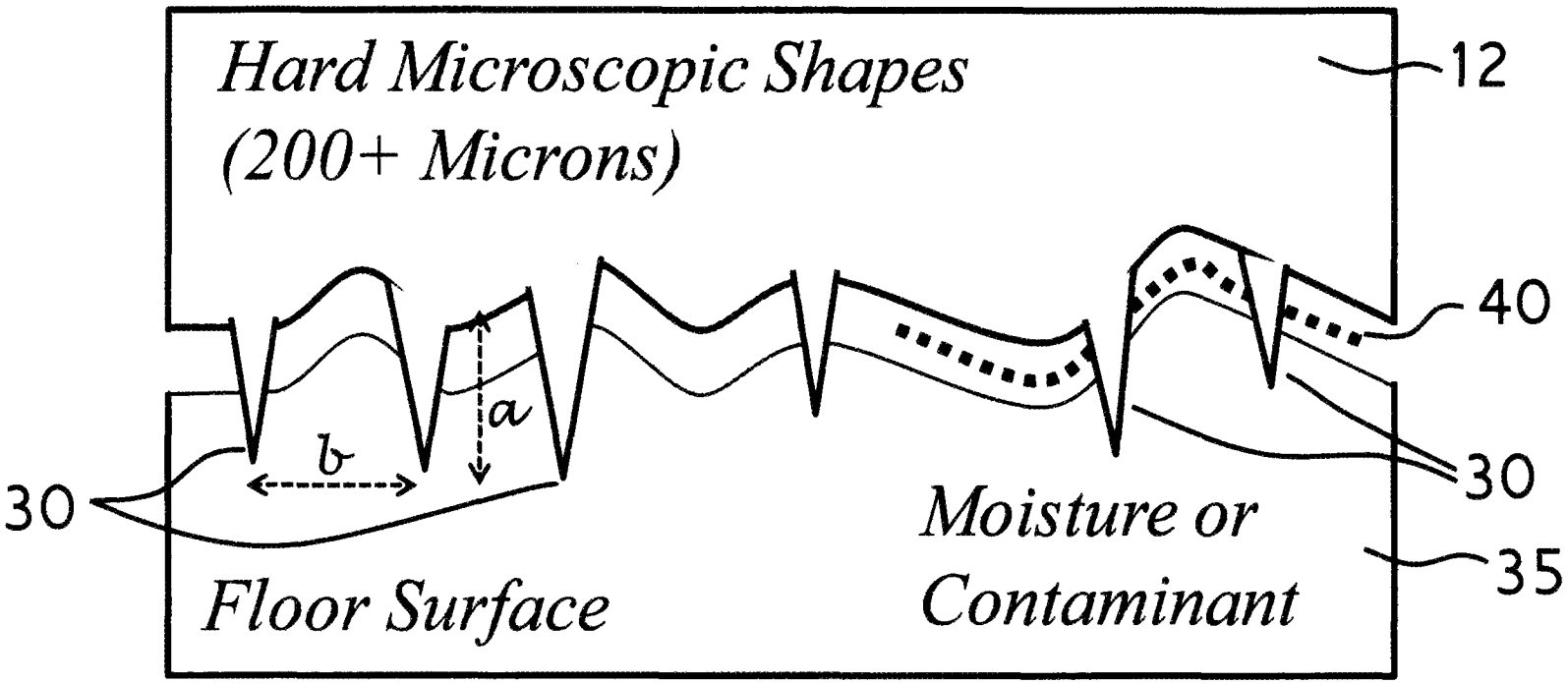
FIG. 2 is cross-sectional view of the microscopic piercing action of the footwear traction apparatus or device of the present invention when in contact with a floor surface with moisture or contaminant present.

The footwear apparatus or device of the present invention comprises a plurality of hard microscopic materials, natural or synthetic, having a shape that is at least 200 microns in diameter, embedded or layered within an epoxy resin in a manner that leaves sharp tips or shapes 30 of the microscopic materials exposed for microscopic piercing of a floor surface 35 as shown in FIG. 2. The hard microscopic shapes 30 are used as a friction additive. The friction additive 30 has an abrasive feel but is safe to touch. The hardest material available is the diamond which is a 10 on the Mohs Hardness Scale. Other more cost effective materials come close to the hardness of a diamond, include, but are not limited to, cubic boron nitride, silicon carbide, titanium carbide, alumina oxide, tungsten carbide, titanium nitride and titanium diboride, all are extremely hard materials with high wear-resistance properties. Silicon carbide having a 9.7 on Mohs Hardness Scale is considered the most cost effective option for this device, but high quality technical grade ceramics are available and constantly improving. The material hardness is important and so are the amplitudes a and wavelengths b of the micro-shapes. In layperson's terms the amplitudes and wavelengths are similar to peaks and valleys in mountain ranges and the foothills of mountains, wherein the distance between the mountain peaks are analogous to wavelength and the upward trajectory of the mountain peak is analogous to amplitude.

Further reference to FIG. 2 shows microscopic shapes 30 embedded in an epoxy resin 12 that remains flexible even when cured. The micro-shapes 30 are designed to create enhanced microscopic traction by using extremely hard materials with larger amplitudes a and smaller wavelengths b. The microscopic materials 30 offer extreme durability and hardness, within a range from approximately 9 to approximately 10 on the Mohs Hardness Scale, in order to pierce any floor surface at the microscopic level. FIG. 2 also shows the microscopic shapes 30 piercing a layer of moisture or contaminant 40 on a floor surface 35.

Footwear Apparatus or Device—Method of Manufacture

Two cost-effective methods of manufacturing the footwear attachment or device are presented as examples, not limitations of the invention.

Example 1

Method of Manufacture—Direct Application to Shoe

First, the sole of a shoe with a ±10° heel bevel is selected so that the micro material can be applied directly to the back of the shoe above the ±10 degree heel bevel. The area above the heel receives a first layer of an adhesive resin in the desired location. Next, a second layer consisting of a plurality of preselected microscopic silicon carbide particles, 200 micron diameter minimum, with the desired shapes, wave lengths and amplitudes are applied to the first layer of the adhesive resin.

Next, a third layer of epoxy resin is applied over the microscopic particles. This third thin layer of epoxy resin anchors all of the particles but does not totally cover them allowing them to pierce the microscopic roughness of any floor surface. These extremely hard shapes combined with the resin layers provide a highly durable product.

Example 2

Method of Manufacture—Mass Production of Individual Devices

Another cost-effective method of manufacturing is via mass production of thin plastic or fiberglass bases that are later glued into a socket on the shoe outsole. The same process used above would be utilized to cover the heel base and the edges of the base. The thinness of each of the two adhesive resins does not impede the ability of the sharp microscopic edges to pierce the microscopic roughness of the floor surface during a slip. The approach allows standard size heel bases to be processed side by side in order to save time and materials. The coated bases could be customized for each footwear manufacturer and shipped to their preferred assembly facilities. Each base would then be glued, and or fastened, to the existing rubber heel. The base shape, the product color and the micro-shape materials are customized cost effectively using this approach. Each alteration, except color changes, would need to be tested in a slip lab.

Thus, Examples 1 and 2 provide at least two means for making the heel attachment of the present invention with embedded microscopic friction additives located in an area that does not obstruct the slip-resistant outsole of a safety shoe during a natural stance.

Figures 3A, 3B, 3C:
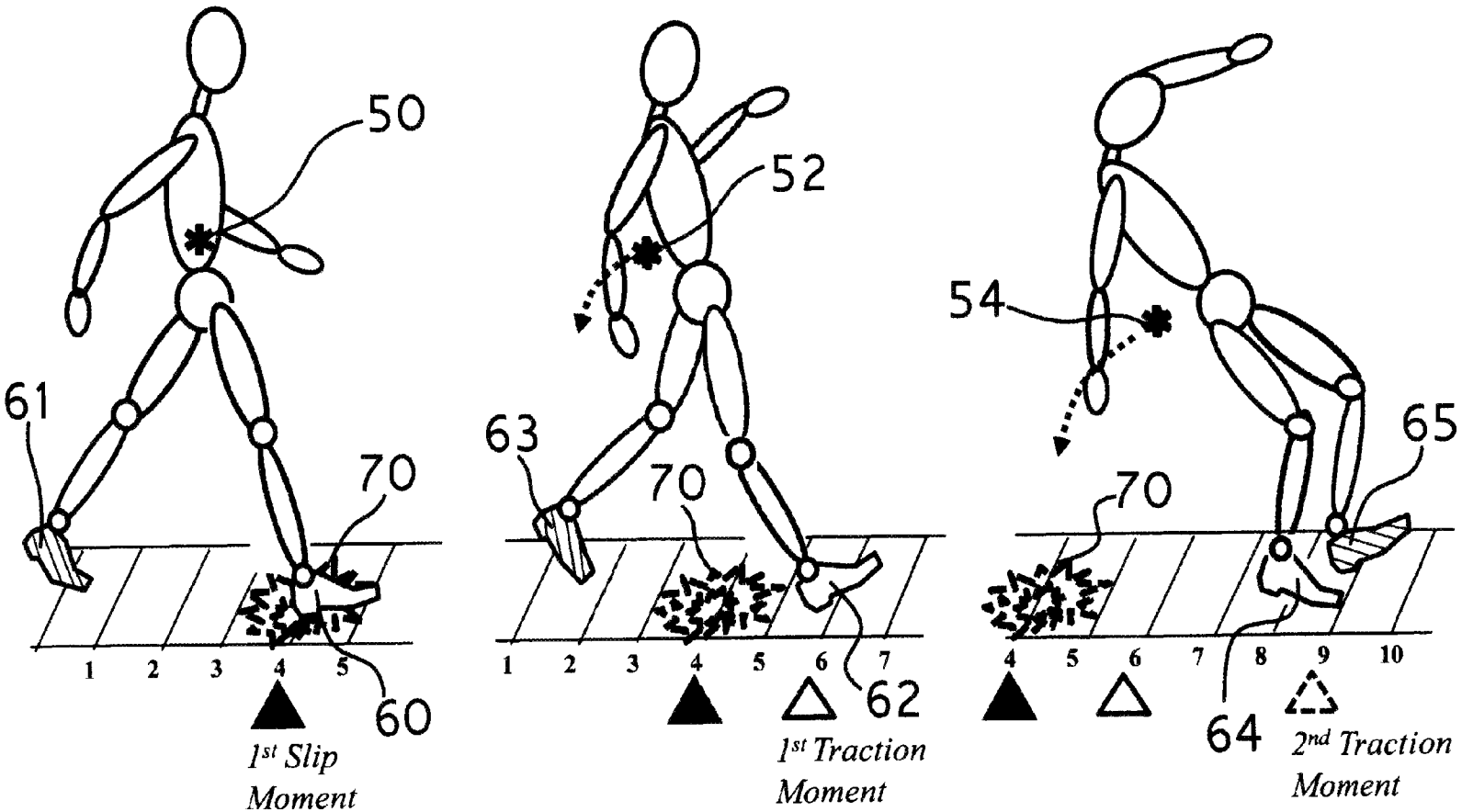
FIG. 3A is a graphic depiction of body positions in the first slip moment using the footwear traction apparatus or device of the present invention.
FIG. 3B is a graphic depiction of body positions in a first traction recovery moment using the footwear traction apparatus or device of the present invention.
FIG. 3C is a graphic depiction of body positions in a second traction recovery moment using the footwear traction apparatus or device of the present invention.

FIGS. 3A to 3C illustrate the effectiveness of the footwear traction apparatus or device of the present invention. In FIG. 3A, the ability of a person to walk safely and preserve balance is shown to be dependent on maintaining the position of the center of mass (COM) 50 over its base of support, the hips and legs. Even with contemporary slip-resistant outsoles people who unexpectedly step onto a slippery surface while walking go through a series of natural responses that force the COM to dangerously rotate rearward.

A rapid slide forward caused by a slip can be slowed down or eliminated during the first 6 to 12 inches of the slide by providing a friction additive to the portion of the footwear that contacts the floor during a natural reaction to a slide. Recovering from the slip by regaining traction early is the best opportunity to stop the rearward rotation of the center of mass (COM) and avoid a fall. If this early opportunity is missed the rearward rotation increases and so do the chances of a serious injury.

Referring now to FIGS. 3A to 3C, it is understood that the shoes on the left and right foot in the illustration are modified with the footwear traction device of the present invention.

FIG. 3A is an illustration of how a slip begins and the footwear traction device of the present invention is used to help one recover from a slip in FIG. 3B and FIG. 3C.

FIG. 3A shows the first moment of a slip occurring when the right heel of a shoe 60 hits a wet or contaminated area 70. The shoe 61 on the left foot is in contact with the walking surface and provides limited stability during the first slip moment. It is noted that contamination build-up can occur from just regular cleaning chemicals commonly used in to restaurants, hotels, hospitals, offices and the like. During the slip, the right heel of shoe 60 is rapidly moving forward while the front of the shoe lifts upward, as shown by the position of shoe 62 in FIG. 3B.

FIG. 3B shows the first traction recovery moment. The micro-shapes on the back of the right heel of shoe 62 provide enough traction to push back and avoid or minimize a fall. In FIG. 3B a slip recovery opportunity occurs within a few inches (approximately 2-6 inches) of when the slip began when the front of the shoe 62 lifts upward the micro-shapes on the back of the right heel come in contact with the floor and provide the first traction moment to alter the center of mass 52 enough to quickly help the walker maintain balance and traction. Note that the shoe 63 on the left foot is no longer in contact with the walking surface; thus, the first traction moment is provided by the footwear traction device on the heel of the right shoe 62.

Another recovery opportunity or safety tactic is shown in FIG. 3C when the left shoe 65 passes the right shoe 64. The micro-shapes on the back of the heel of the left shoe 65 provide enough traction to avoid the fall or at least reposition the body for a less damaging fall.

If the fall is unavoidable or the person can't recover his or her balance because the center of mass 54 is no longer over its base of support, the extra friction from the heels of both shoes 64, 65 allows the person to spread the force of the fall over a larger area.

In the second traction moment in FIG. 3C there is both a right and left traction moment that serves to minimize absolute force and provide a safer trajectory during a fall. The emergency traction provided by the footwear traction apparatus and device of the present invention yields surprisingly positive results.

Figure 4:
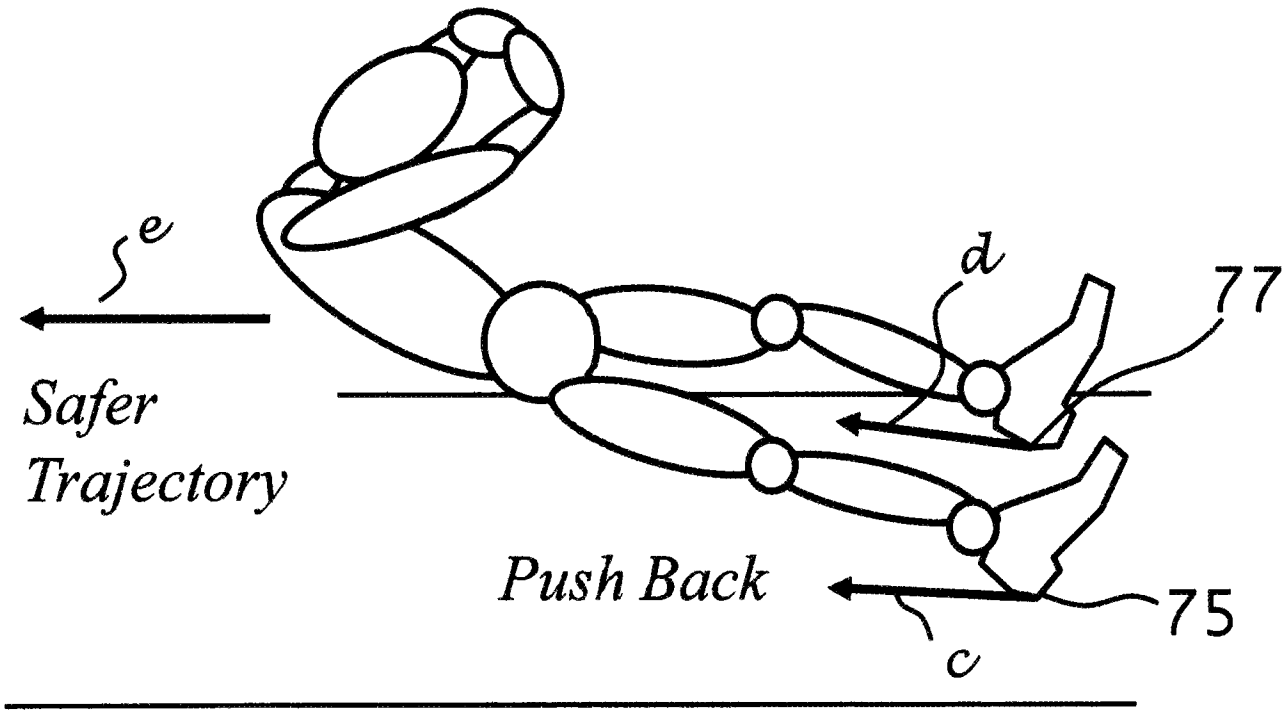
FIG. 4 is a graphic depiction of body positions in a safer fall position using the footwear traction apparatus or device of the present invention.

FIG. 4 shows that traction from both heels 75, 77, even if very off-balance, is used to push back against the floor in the direction of the arrows c and d in order to alter the body's trajectory e towards a safer landing position. The push back force reduces the risk of severe injury by spreading the impact force over a larger area. The duration of falling is increased and the impact force is reduced.

Figure 5:
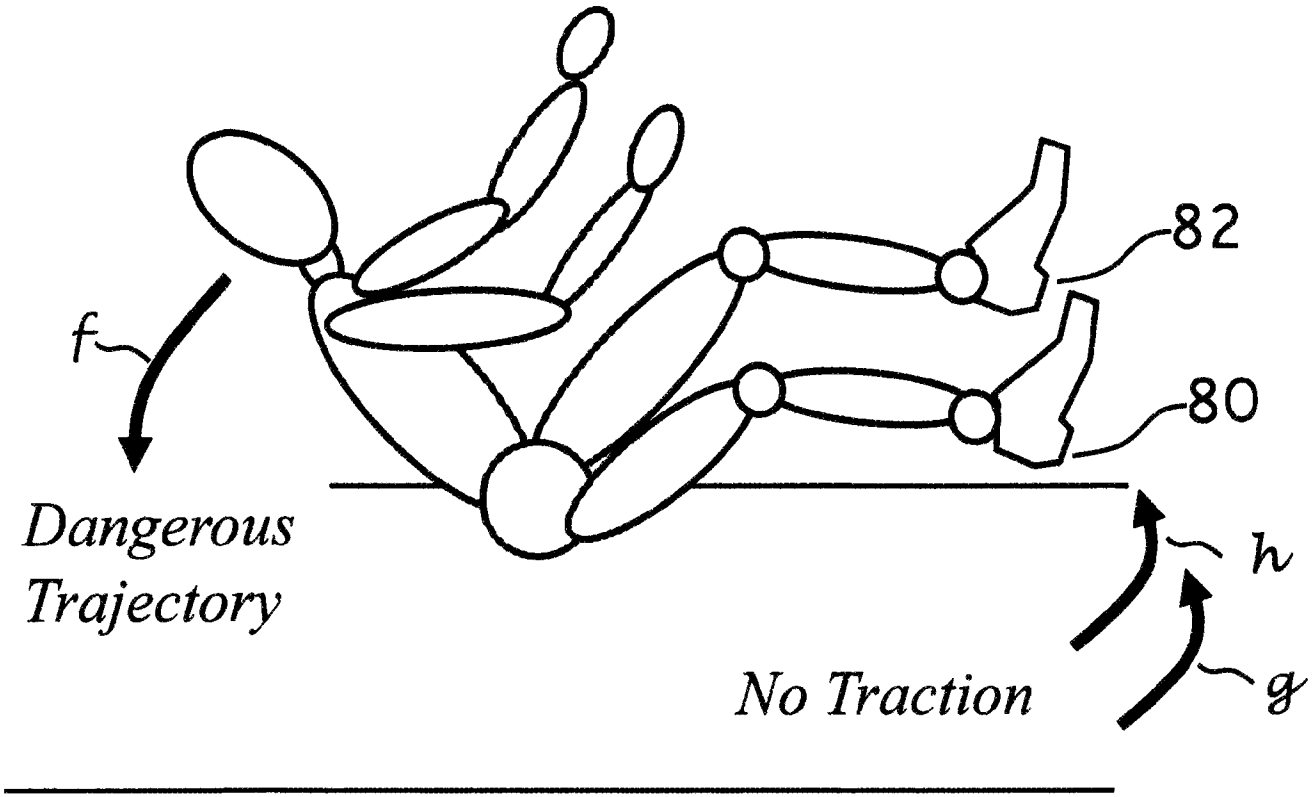
Fig. 5 (Prior Art)
FIG. 5 is a graphic depiction of body positions in a deadly fall position using footwear without the traction apparatus or device of the present invention. (Prior Art)

In contrast, FIG. 5 shows a deadly fall position of a wearer of footwear without the footwear traction apparatus or device of the present invention. Without emergency piercing traction both heels 80, 82 leave the ground and a fall can longer be avoided. This type of slip creates a dangerous trajectory f Meeting a force with a directly opposing force (floor) maximizes the absolute force felt by any one part of the body. There is no push back traction available; the fall energy travels in the direction of arrows g and h with both feet off the floor. If push back traction were available, the fall energy would be directed in a more useful way to minimize the absolute force felt by the head or hips.

Figures 6, 6A, 6B, 6C:
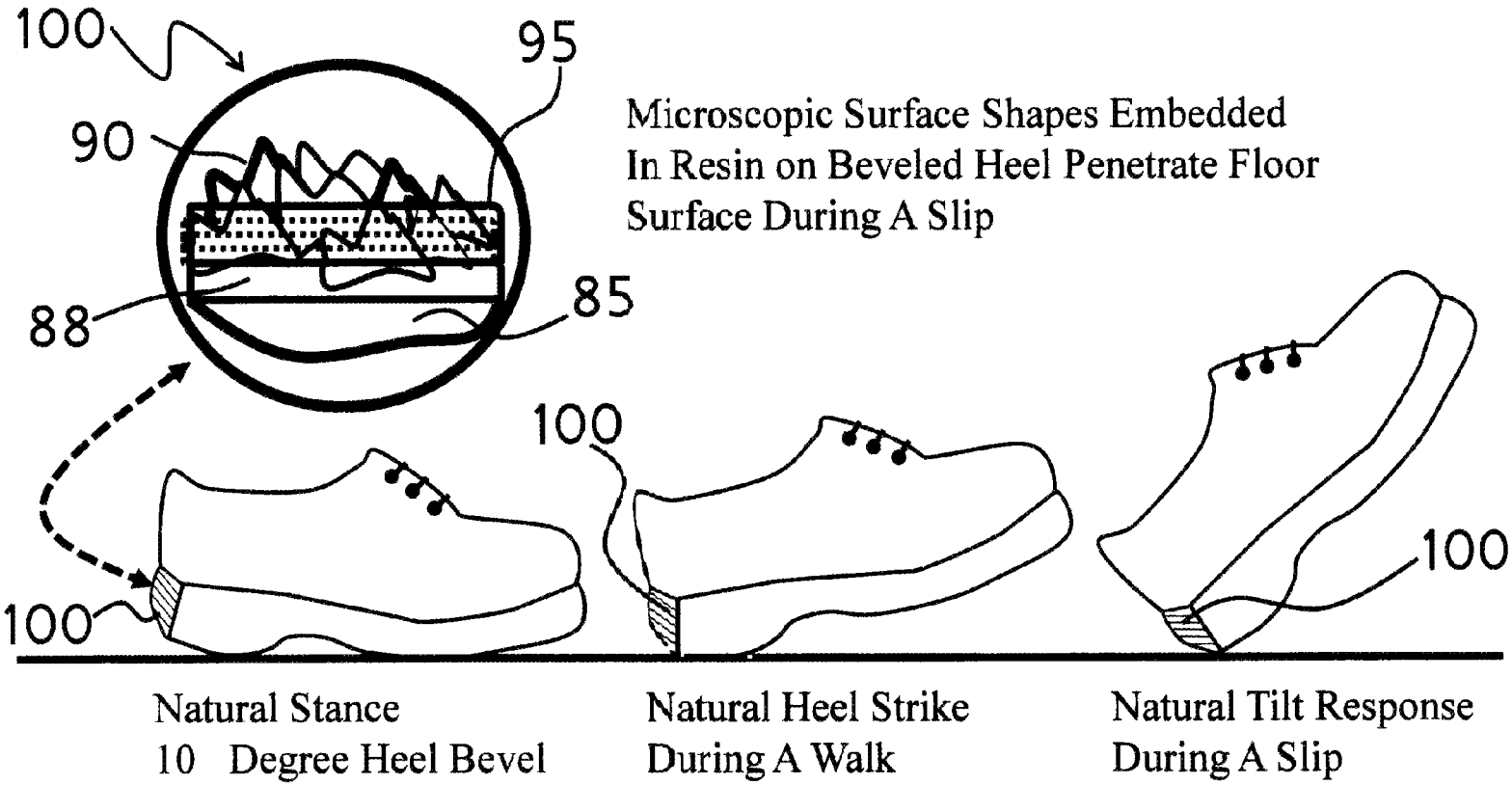
FIG. 6 is an enlarged cross-sectional view of microscopic surface shapes embedded in resin as a first embodiment of the footwear traction apparatus or device of the present invention that is subsequently attached to a beveled heel of a shoe.
FIG. 6A is a side view of a shoe with the first embodiment of the footwear traction apparatus or device of the present invention attached to the heel of a shoe in a natural stance showing approximately 10 degree heel bevel.
FIG. 6B is a side view of a shoe with the first embodiment of the footwear traction apparatus or device of the present invention attached to the heel of a shoe showing a natural heel strike during a walk.
FIG. 6C is a side view of a shoe with the first embodiment of the footwear traction apparatus or device of the present invention attached to the heel of a shoe in a natural tilt response during a slip.

FIG. 6 is an enlarged cross-sectional view of the footwear attachment of the present invention 100 showing the overall structure with microscopic surface shapes imbedded in resin, providing protrusions having amplitudes and wavelengths, in a layered composition. The curve attachment dimensions vary based on the type of footwear. For example, a flat, flexible substrate 85 is covered with a base adhesive resin layer 88 with a thickness of approximately 250 microns, then a plurality of natural or synthetic microscopic particles 90 having an minimum size of 200 microns in diameter are applied to the base adhesive resin 88, then a thin anchor coating of an epoxy resin 95 covers the microscopic particles 90. The epoxy resin coating 95 can have a thickness of approximately 500 to 700 microns and anchors the microscopic particles 90 to the base adhesive layer 88 and the flat substrate 85, leaving the sharp tips of the microscopic particles 90 exposed as the coating 95 cures and thins.

A method of preparing the customized footwear traction attachment shown in FIG. 6 includes a layering system that begins with selecting a flat, flexible substrate 85 spraying the substrate with a first liquid adhesive resin 88 to form layer one, then spraying microscopic particles 90 onto the adhesive resin 88, allowing the microscopic particles to adhere and embed in the adhesive resin to form layer two. A second liquid epoxy resin 95 is sprayed onto the microscopic particles 90 to coat the particles and form layer three. The epoxy resin coating 95 is allowed to cure and shrink to expose the sharp tips of the microscopic particles 90.

The flat, flexible substrate 85 chosen for the base shape can be plastic, rubber, aluminum or the like. The adhesive resin 88 and epoxy resin 95 for layers one and three, respectively, are available commercially from suppliers, such as, the 3M Company, St. Paul, Minn.

A person of ordinary skill in the art can make a judicious selection of the materials required for the manufacture of the footwear traction device using the materials identified and dimensions set forth herein as a guideline that will require adjustment based on shoe size, style and environmental parameters.

The overall dimensions of the footwear traction apparatus or device are approximately 40 mm-50 mm (1.36-1.96 inches) in length, 10 mm-20 mm (0.39-0.78 inches) in height and approximately 5 mm-8 mm (0.2-0.31 inches) in depth.

FIGS. 6A-6C are illustrations of how the microscopic surface shapes embedded in resin and attached to the heel of a shoe penetrate the floor surface during a slip. Beginning with FIG. 6A, a shoe with ±10 degree heel bevel has heel attachment 100 located in an area that does not obstruct the slip-resistant outsole in a natural stance position.

FIG. 6B shows that the attachment 100 also does not contact the floor surface during the natural heel strike during a walk. If the natural heel strike lands in a slippery area the first phase of a fall begins, the sole makes full contact with the floor and rapidly slides forward. The natural response to the forward slide is an increased angle or upward tilt of the toe of the shoe, wherein the angle to the ground exceeds approximately 35 degrees, allowing the friction additive or attachment 100 to come in contact with the floor, pierce and grip the microscopic roughness of the floor and provide enough traction to push back in order to recover from the initial slip (see FIG. 6C).

Figure 7:
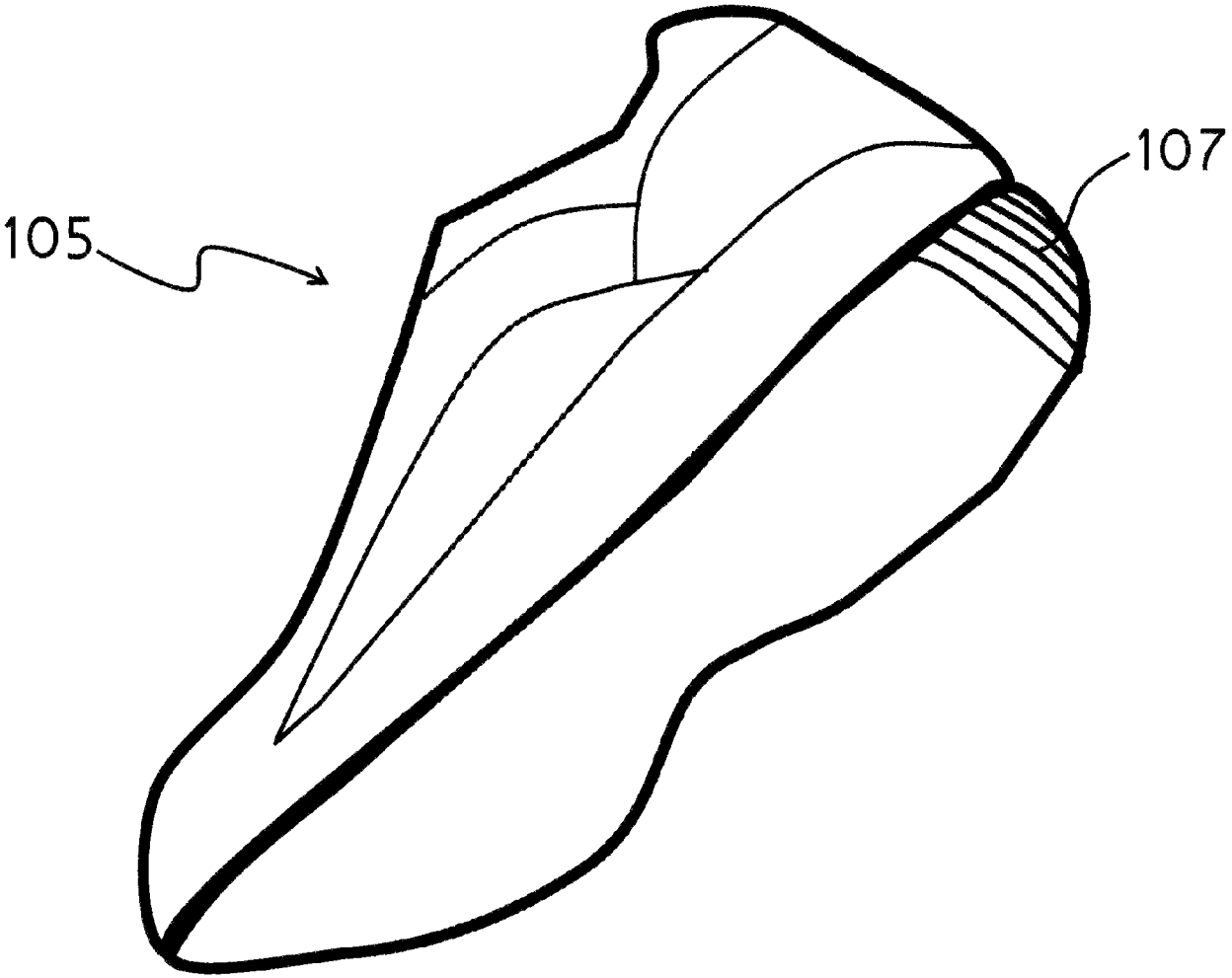
FIG. 7 is a graphic illustration of a manufactured shoe showing the location of the footwear traction apparatus or device of the present invention on the beveled section of the shoe sole.

FIG. 7 is a design of a slip-resistant safety shoe 105 with the footwear traction apparatus or device of the present invention 107 applied to the beveled heel of a safety sole. The beveled area is a located at the heel of a shoe and forms a surface that joins the sole of the shoe at an angle that is not a right angle; the most preferred angle is approximately 10 degrees.

Figure 8:
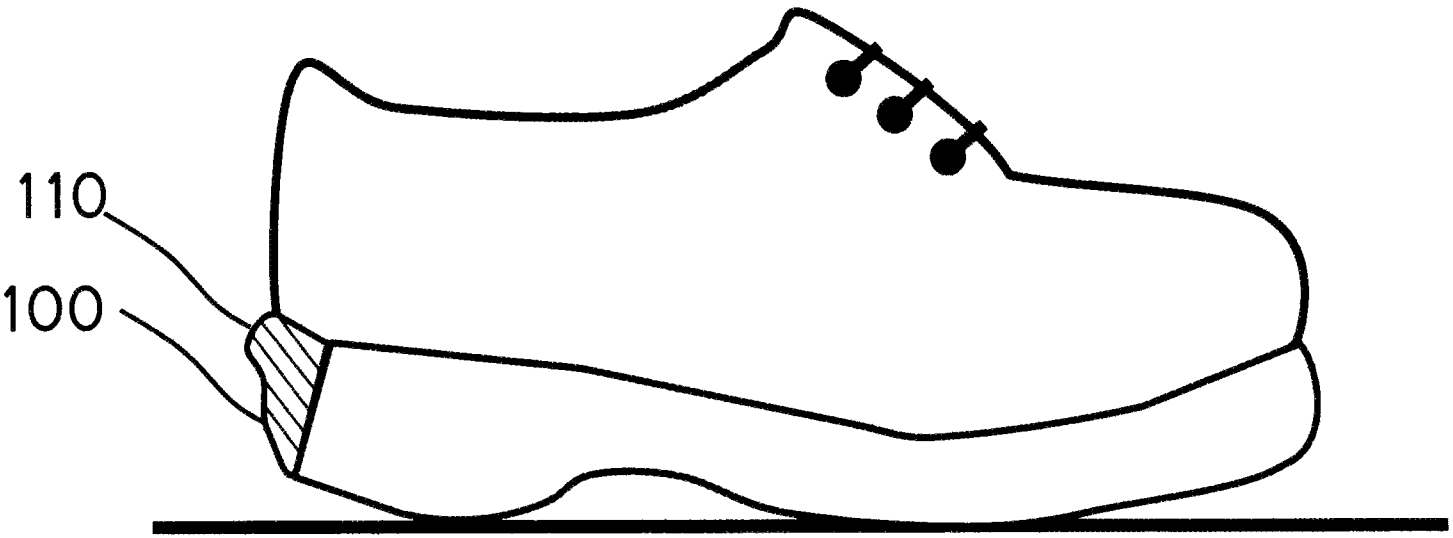
FIG. 8 is a side view of a second embodiment with double heel push off friction for unavoidable falls. The second embodiment of the footwear traction apparatus or device of the present invention is attached to the heel of a rubber soled shoe.

FIG. 8 is an illustration of how basic shapes can be customized for specific needs. The shape of the heel attachment 100 with a lip 110 enhances double heel push off friction for unavoidable falls. The additional contact area from the lip 110 is located in an area that would provide additional measurable traction only after the COM is severely compromised, in other words a fall will occur, but the fall trajectory can still be altered for a safer landing.

This effective and economically viable solution does not require footwear manufacturers to incur expensive changes in the way they design or make footwear.

This invention further contemplates a system for varying the heel shape and varying the microscopic surface particles to increase effectiveness based on human slip tests and or less accurate specialty machine or software simulations. The aim of the invention is to aid wearers of slip-resistant rubber outsoles and help workers recover from a "slip in progress" in order to avoid the ensuing fall. As a last resort the invention will provide the necessary traction to position the body for a safer fall by minimizing the absolute force.

Performance Testing

Today safety shoe manufacturers use coefficient of friction (COF) as a measurement of performance. Slip science labs provide more realistic data, and in safe environments, utilize human test subjects. COF is no longer considered a reliable indicator of fall prevention capability, but is still used when marketing safety shoes. Recent studies demonstrate the inadequacies with COF as a reliable indicator of fall prevention as reported by I-J Kim et al in "Research on Slip Resistance Measurements—A New Challenge," *Industrial Health* 2008, 46, 66-76.

Thus, the primary focus of the state of the art safety shoe market is slip-resistant solutions not slip-recovery, as is the focus of the present invention.

For the present invention, test subjects are safely introduced to unexpected slippery areas to determine how often the device allows the subject to recover from a slip. Human slip tests are most accurate and can be combined with less accurate specialty machine tests or software simulation testing. Lab and simulation testing quantify how often a safer fall position is achieved in the event that a fall cannot be avoided. Standard human slip lab equipment includes a fall arresting rig, safety harness, high-speed video equipment and force measurement sensors under the fall area. A glass force plate used to observe shoe and floor interfaces. A computer controlled pin-on-disk friction tester and non-contact 3-D surface profiler allow close-up observation of differences between shoe and floor materials, their interactions, and friction variations in the presence of contaminants.

The present invention exploits the human factors that contribute to a loss of balance during a slip with a footwear add-on that uses microscopic materials to provide multiple slip recovery opportunities. This recovery strategy works, because the product is designed to react rapidly with the natural human response to control the rearward rotation of the body. The additional traction allows a person to execute a recovery step in the early stages, such as, the first 12 inches, of a dangerous slip.

Figure 9:
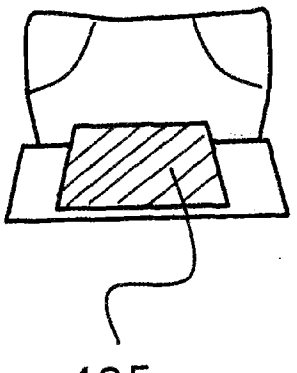
FIG. 9 is a rear view of a shoe with a beveled heel showing the footwear traction apparatus or device of the present invention above the heel bevel.
Figure 9A:
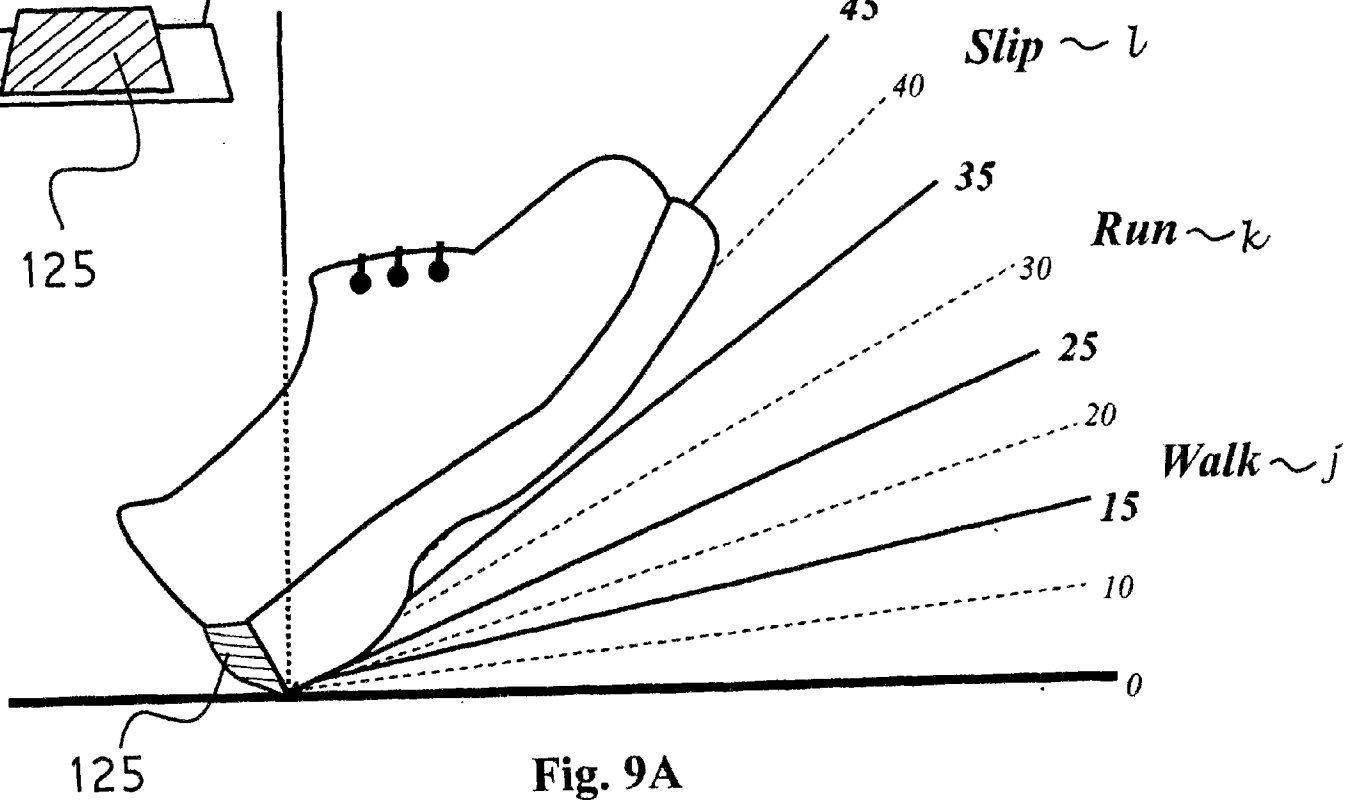
FIG. 9A is a graphic illustration of how the footwear traction apparatus or device at the time of heel impact wherein the foot is angled upward with the shoe sole at angles between 0° from the surface when standing and approximately 45° from the surface after slipping.

In summary, FIG. 9 shows a push-back traction footwear safety apparatus or device 125 of the present invention on the heel of a shoe. The device helps to reposition the center of mass in order to avoid a fall. In FIG. 9A, there is a graphic illustration of the various angles of the foot to the ground at the time of impact during a walk j, a run k, and a slip l. The angle of the heel of the shoe to the ground is between approximately 0° to 20° when walking; when running the angle of the shoe to the ground is between approximately 20° to approximately 35°. When slipping, the angle will naturally exceed 35 degrees and allow the footwear safety attachment 125 to engage the walking surface.

In its embodiments, the present invention contemplates a low cost heel system that compliments the slip-resistant outsolcs commonly used in workplace environments. The microshapes on the footwear attachment pierce and grip the floor surface and any contaminants to create guaranteed and measurable traction. The microscopic particles embedded in the device are harder and stronger than all floor surfaces including tile, cement, stone, and steel floors. The shape of the traction device is cost-effectively customized and safety tested for each outsole design. The final shape and friction properties of the device can be formulated by altering the amounts and types of densification aids.

Prior to the present invention, it was not known that a footwear attachment is capable of influencing slip displacement and allowing the person who has slipped to recover dynamic stability. Finally, there is a product that can reduce the cost of injuries from falls on level surfaces which are considered the most disabling U.S. workplace injuries costing over $6.4 billion in U.S. workers compensation each year according to Liberty Mutual Insurance Company.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A footwear traction device that provides multiple slip recovery opportunities, comprising in combination:

a shoe having an outsole with a bottom surface between a front end and a rear end adapted to contact a walking surface, and a heel located behind the rear end of the outsole, the heel having a bottom surface adapted to contact the walking surface, and a beveled surface formed on an outer most part of the heel, said beveled surface is specifically designed to not contact the walking surface until a person walking on the walking surface begins to slip;

a layered composition only on the beveled surface of the heel, the layered composition having micro-shapes in a layered configuration, consisting of:

a first layer of a smooth base adhesive material, a second layer of a plurality of microscopic particles with sharp tips and pointed shapes having a hardness between approximately 9 and approximately 10 on the Mohs Hardness Scale, embedded in the first adhesive layer, and a third layer of an epoxy resin coating covering the plurality of microscopic particles and the first layer of the smooth base adhesive material, wherein the epoxy resin leaves sharp tips and pointed shapes of the microscopic material exposed for microscopic piercing of a walking surface; and the first adhesive layer for allowing the layered composition with micro-shapes to directly attach only to the beveled surface on the heel of the shoe, wherein the beveled surface on the heel and its attached composition in combination does not contact the walking surface until the a person walking on the walking surface begins to slip.

2. The footwear traction device of claim 1, wherein the beveled heel structure is at least one of leather or a synthetic material the outsole of the shoe is at least one of rubber, a natural elastic material, and a synthetic material.

3. The footwear traction device of claim 1, wherein the plurality of microscopic particles is selected from the group consisting of engineered ceramics, diamond, cubic boron nitride, silicon carbide, titanium carbide, alumina oxide, tungsten carbide, titanium nitride, titanium diboride and a mixture thereof.

4. The footwear traction device of claim 3, wherein the microscopic particle is at least one of silicon carbide or engineered ceramics.

5. The footwear traction device of claim 1, wherein the device measures approximately 40 mm-50 mm (1.36-1.96 inches) in length, 10 mm-20 mm (0.39-0.78 inches) in height and approximately 5 mm-8 mm (0.2-0.31 inches) in depth with amplitudes and wavelengths creating an irregular shaped outer surface coated by a layer of an epoxy resin with a thickness of approximately 500-700 microns that covers a second layer of a plurality of microscopic particles that adhere to the first layer of the smooth base adhesive.

6. The footwear traction device of claim 5, wherein the plurality of microscopic particles each has a diameter of at least approximately 200 microns.

7. The footwear traction device of claim 6, wherein the plurality of microscopic particles each has the sharp tips and the pointed edges that protrude through the layer of an epoxy resin that covers the plurality of microscopic particles and the protruding tips take the brunt force necessary to stop a slip-in-progress.

8. A method of only modifying a beveled heel surface of a shoe to prevent slipping, the method comprising the steps of:

providing a shoe having a outsole with a front end and a rear end and a bottom surface there between for contacting a walking surface;

providing a heel on the shoe behind the rear end of the outsole, the heel having bottom surface for contacting a walking surface, and a beveled surface on an outer most part of the heel of the shoe, said beveled surface is specifically designed not to contact the walking surface until a person walking on the walking surface begins to slip;

attaching directly a first layer of a smooth base adhesive material only to the beveled surface of the heel;

embedding a second layer of a plurality of microscopic particles with sharp tips and pointed shapes having a hardness between approximately 9 and approximately 10 on the Mohs Hardness Scale, in the first adhesive layer only on the beveled surface of the heel; and attaching directly a third layer of an epoxy resin coating covering the plurality of microscopic particles and the first layer of the smooth base adhesive material, wherein the epoxy resin leaves the sharp tips and the pointed shapes of the microscopic material exposed only from the beveled surface of the heel of the shoe for microscopic piercing and gripping of the a walking surface when the person on the walking surface begins to slip.

9. The method of claim 8, wherein the beveled heel structure is at least one of leather and synthetic material.

10. The method of claim 8, wherein the plurality of microscopic particles is selected from the group consisting of engineered ceramics, diamond, cubic boron nitride, silicon carbide, titanium carbide, alumina oxide, tungsten carbide, titanium nitride, titanium diboride and a mixture thereof.

11. The method of claim 10, wherein the microscopic particle is at least one of silicon carbide or engineered ceramics.

12. The method of claim 8, wherein the device measures approximately 40 mm-50 mm (1.36-1.96 inches) in length, 10 mm-20 mm (0.39-0.78 inches) in height and approximately 5 mm-8 mm (0.2-0.31 inches) in depth with amplitudes and wavelengths creating an irregular shaped outer surface coated by a layer of an epoxy resin with a thickness of approximately 500-700 microns that covers a second layer of a plurality of microscopic particles that adhere to the first layer of the smooth base adhesive.

13. The method of claim 12, wherein the plurality of microscopic particles each have a diameter of at least approximately 200 microns.

14. The method of claim 13, wherein the plurality of microscopic particles each has the sharp tips and the pointed edges that protrude through the layer of an epoxy resin that covers the plurality of microscopic particles.

* * * * *